US006688478B2

(12) United States Patent
Miller, Jr. et al.

(10) Patent No.: US 6,688,478 B2
(45) Date of Patent: Feb. 10, 2004

(54) PRODUCT STORAGE AND MERCHANDISING UNIT

(75) Inventors: Donald J. Miller, Jr., Belleville, IL (US); Maynard Johnson, Ballwin, MO (US); Andrew Boron, Belleville, IL (US)

(73) Assignee: Paul Flum Ideas, Inc., St. Louis, MO (US)

( * ) Notice: Subject to any disclaimer, the term of this patent is extended or adjusted under 35 U.S.C. 154(b) by 0 days.

(21) Appl. No.: 09/683,689

(22) Filed: Feb. 4, 2002

(65) Prior Publication Data

US 2003/0146177 A1 Aug. 7, 2003

(51) Int. Cl.[7] ..... A47F 1/04

(52) U.S. Cl. ..... 211/59.2; 211/90.03; 211/118; 211/175; 211/181.1; 211/187

(58) Field of Search ..... 211/90.03, 59.2, 211/113, 118, 119, 181.1, 134, 186, 46, 90.01, 133.5, 117, 175, 41.5, 41.6, 74, 75, 106, 106.1, 135; 108/29, 30; 248/340, 339, 690, 317, 240.2, 235, 249

(56) References Cited

U.S. PATENT DOCUMENTS

| | | | | | |
|---|---|---|---|---|---|
| 1,878,177 | A | * | 9/1932 | Pedersen | 211/45 |
| 2,640,599 | A | * | 6/1953 | Hess | 108/29 |
| 3,945,462 | A | * | 3/1976 | Griswold | 182/150 |
| 4,162,730 | A | * | 7/1979 | Steere et al. | 211/118 |
| 4,169,638 | A | * | 10/1979 | Cirasuolo et al. | 312/229 |
| 4,424,908 | A | * | 1/1984 | Davitz | 211/118 |
| 4,595,106 | A | * | 6/1986 | Kunze et al. | 211/118 |
| 4,974,523 | A | * | 12/1990 | Giarratana | 108/42 |
| 5,272,991 | A | * | 12/1993 | Carrigan, Jr. | 108/108 |
| 5,350,071 | A | * | 9/1994 | Pond | 211/70.6 |
| 5,427,344 | A | * | 6/1995 | Beauchemin | 248/218.4 |
| 5,527,007 | A | * | 6/1996 | Weilbacher | 248/304 |
| 5,601,038 | A | * | 2/1997 | Welch et al. | 108/193 |
| 5,749,479 | A | * | 5/1998 | Belokin et al. | 211/113 |
| 5,755,341 | A | * | 5/1998 | Spamer | 211/59.2 |
| 5,779,068 | A | * | 7/1998 | Whiten et al. | 211/117 |
| 5,875,902 | A | * | 3/1999 | Emery et al. | 211/90.03 |
| 5,908,119 | A | * | 6/1999 | Kump et al. | 211/113 |
| 6,044,983 | A | | 4/2000 | Hall | |
| 6,311,852 | B1 | * | 11/2001 | Ireland | 211/59.2 |
| 6,341,704 | B1 | * | 1/2002 | Michel, Jr. | 211/181.1 |
| 6,368,499 | B1 | * | 4/2002 | Sharpless | 210/164 |
| 6,386,096 | B1 | * | 5/2002 | Tiemann | 99/426 |
| 6,454,223 | B1 | * | 9/2002 | Rosky | 248/100 |
| 6,497,331 | B1 | * | 12/2002 | Morandi | 211/153 |
| 2002/0023888 | A1 | * | 2/2002 | Wynne et al. | 211/119 |

* cited by examiner

*Primary Examiner*—Daniel P. Stodola
*Assistant Examiner*—Jennifer E. Novosad
(74) *Attorney, Agent, or Firm*—Blackwell Sanders Peper Martin, LLP

(57) ABSTRACT

A product storage and merchandising unit adaptable for attachment to the underside portion of existing product merchandising equipment, the present unit having a plurality of openings positioned adjacent at least a portion of either the top or bottom portion of each of the opposed side portions thereof, the openings being adaptable for receiving appropriate attachment members for attaching the unit to the underside portion of the product merchandising equipment located thereabove. The attachment members may take the form of hook members, tie-type fasteners or other appropriate members, each attachment member being engageable with both the existing product merchandising equipment and at least one of the openings associated with the opposed side portions of the unit. In one embodiment, at least two sets of openings positioned in spaced apart parallel and aligned relationship to each other are associated with each of the opposed side portions of the unit.

22 Claims, 5 Drawing Sheets

PRODUCT STORAGE AND MERCHANDISING UNIT

BACKGROUND OF INVENTION

The present invention relates generally to product display devices for use in storing and merchandising shelved products and, more particularly, to a product display and storage unit adapted to attach to the underside portion of an existing shelf located immediately thereabove thereby making use of the space already existing between conventional product shelving. Although the present unit is designed primarily for use in a wide variety of refrigerated display cases presently used in supermarkets, convenience stores, and other food and beverage outlets, it is likewise adaptable for use in many other product display and merchandising applications.

A wide variety of shelving and display devices have been designed and manufactured for use in merchandising shelved products to consumers. These devices are commonly used in convenience stores, grocery stores and the like to store and display products such that they can be easily seen and retrieved by a customer. The dual storage and merchandising function performed by product shelving is particularly important due to the limited space available within a given store or merchandising area. Space for merchandising and storing products in supermarkets, convenience stores, or other food/beverage outlets is limited by the square footage of the particular facility in question. This space is further limited by the fact that various areas of the store must serve functions other than storage and display of products, such as checkout areas, warehouse areas, and aisles through which customers and employees of the facility can walk. Increasing warehouse space for storage of additional products is undesirable because this means the merchant must sacrifice a proportionate amount of space that could be used for displaying and selling products. Expansion of available space by undertaking construction projects to add on to the facility is costly and may be limited or rendered impossible by the size of the lot or by adjacent facilities. The problem of space is particularly acute in the environment of a convenience store since these types of stores generally have much less space to work with than do traditional grocery stores.

Thus, the inefficient use of available shelf space, particularly the vertical space between adjacent shelves, is one of the major problems associated with the storage and display of shelved products for sale to consumers. This problem is exacerbated when it comes to storing shelved products requiring refrigeration in display coolers and other types of cold vaults due to the costs associated with cooling each unit of area used to store cold items. Because of these costs, a merchant has only a limited space in which to display and merchandise cold items and every area of refrigerated-but-unused space costs the merchant money.

The space between conventional product shelves is generally more than sufficient to store and display certain products. As a result, there exists a potentially useful but unused space between the top of the products stored on one shelf and the bottom of the shelf located immediately above. This space comprises valuable real estate to the merchant because it is additional space that can be utilized to store and merchandise products. By making use of this space, the merchant is able to store and merchandise additional products without having to expand the store or encroach on areas of the store dedicated to other purposes. In the case of refrigerated items, the merchant is able to store and merchandise additional products without having to bear the costs of additional refrigeration units or other merchandising equipment.

Thus, there exists a need for a product storage and merchandising unit that is able to take advantage of this unused space and thereby allow the merchant to realize maximum profit from space that is already available for use.

SUMMARY OF INVENTION

The present invention overcomes many of the problems associated with the lack of storage and display space in supermarkets, convenience stores, and other food and beverage outlets and teaches the construction of several embodiments of a horizontally arranged product merchandising and storage unit which can be used for both chilled and unchilled products, which is particularly well-suited to merchandising and displaying a wide variety of products therefrom such as energy drinks, soft drinks, fruit juices, dairy products, and the like, and which is capable of utilizing the generally unused space immediately below a convention shelf. The present units are adapted for use with existing product shelving and are suspended therefrom such that they hang beneath an existing product shelf. The present units provide a support structure for display and storage of products therefrom as well as for gravity feeding products to maintain such products within easy reach of a customer.

One embodiment of the present shelf unit includes first and second side members, each side member including a plurality of openings spaced along an upper edge portion thereof in order to provide a mechanism by which the unit may be secured to a conventional shelf located thereabove. A plurality of transverse members extend at least substantially across the width of the present unit in spaced apart relationship to each other between the first and second side members. The transverse members are arranged in a generally parallel fashion and provide stability and support to the overall unit. At least one stop member extends between the first and second side members adjacent the front portion of the unit to retain the products therewithin when the unit is mounted beneath a conventional shelf.

A plurality of channel members extend longitudinally along at least substantially the length of the unit forming segregated channels in which products may be stored. The channel members extend upwardly from a position adjacent the front stop member and then extend longitudinally along the length of the unit before extending downwardly for attachment to the rearwardmost transverse member. The channel members are spaced in generally parallel arrangement forming at least two product channels in which products may be stored. A plurality of longitudinal members likewise extend at least substantially along the length of the device adjacent the transverse members between the front and rearwardmost transverse members forming a track-like bottom surface for supporting products thereon. The longitudinal members are arranged such that at least two such members are positioned and located within each product channel for supporting products when positioned thereon. The spacing and arrangement of the longitudinal members within each product channel can be varied depending upon the particular type of products to be stored and displayed therein.

Attachment members are also provided for attaching the present unit to the underside of existing shelf units. Depending upon the type of merchandising equipment in which the present unit will be used, the attachment members may take the form of a plurality of hook members sized and shaped such that one end of a hook member may be received within one of the plurality of openings in a side member and the other end of the hook member may be fastened or otherwise engaged to the underside of an existing product shelf, or such attachment members may take the form of a plurality of tie members sized and shaped so as to loop through a respective opening in a side member and around a member associated with the underside portion of an existing product shelf located above. Any number of attachment members may be used to properly orient and position the present unit below the shelf member located immediately thereabove.

Another embodiment of the present unit includes a plurality of openings associated with the lower edge portion of each respective side member or side wall for receiving suitable attachment members for attaching the present unit to a shelf member located thereabove, the location of the openings associated with each side wall or side member providing different attachment options to the user and, in some cases, better stability depending upon the particular type of shelf member to which it is attached.

Thus the present devices provide a convenient means for utilizing valuable but previously unused space between existing product shelves, particularly existing shelves within a wide variety of different refrigerated display units. The present devices can also be easily oriented to provide convenient gravity feeding of the products stored within each product channel. Furthermore, the present devices provide a convenient means by which pricing and other merchandising information regarding the products stored therein may be conveyed to the customer.

These and other advantages of the present invention will become apparent to those skilled in the art after considering the following detailed specification which discloses several representative embodiments of the present product storage and merchandising unit in conjunction with the accompanying drawings.

DETAILED DESCRIPTION

Figure 1:
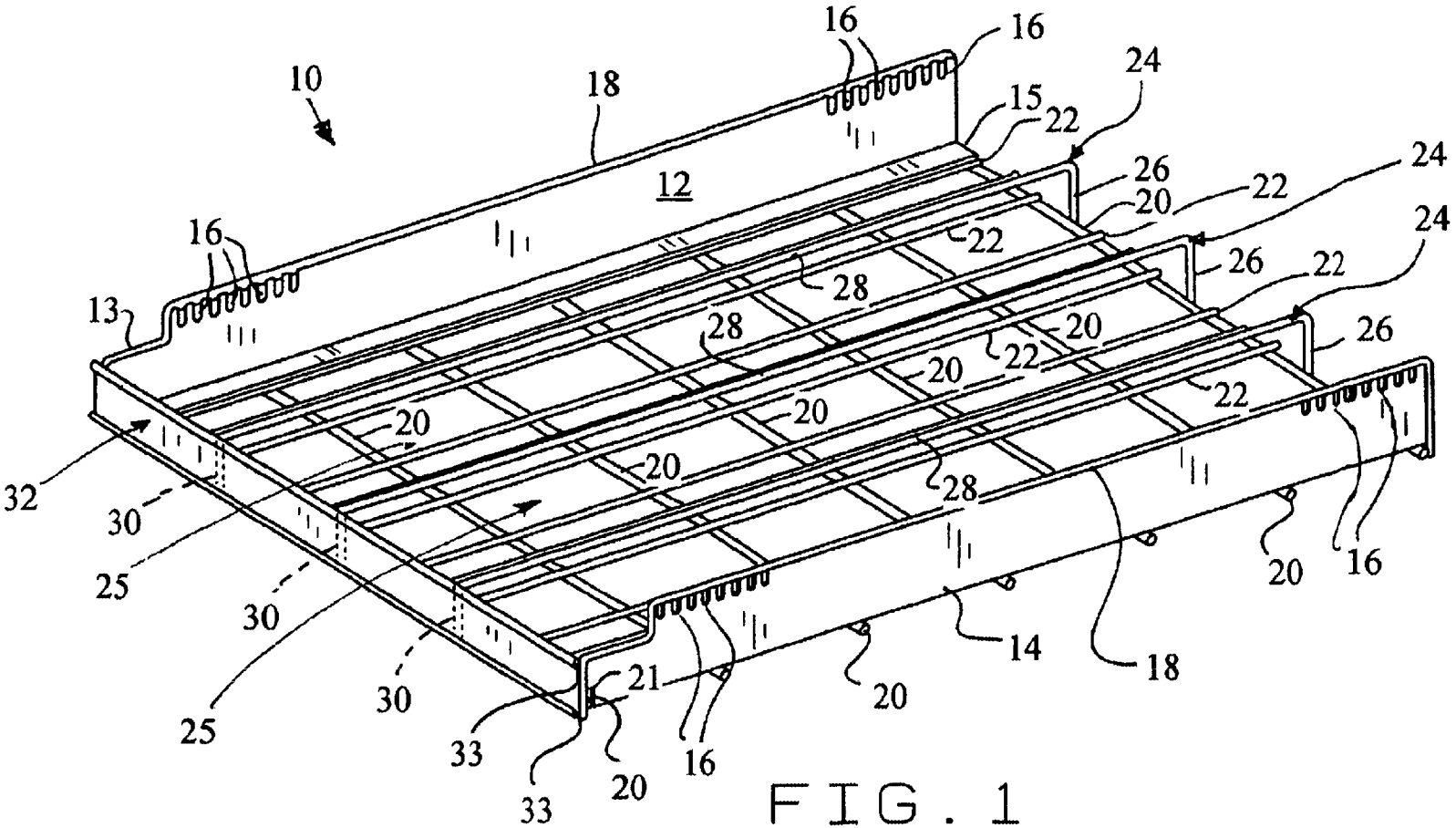
FIG. 1 is a perspective view of one embodiment of a product storage and merchandising unit constructed in accordance with the teachings of the present invention.

Referring to the drawings more particularly by reference numbers wherein like numerals refer to like parts, number 10 in FIG. 1 identifies one embodiment of a product storage and display unit constructed according to the teachings of the present invention. The unit 10 includes side members 12 and 14 which extend substantially along the length of the unit 10. The side members 12 and 14 define the opposing sides of the unit and are preferably constructed of unitary sheets of material having both upper and lower limits, each side member having a front portion located substantially at the front of the unit 10 and a rear portion located substantially at the rear of the unit 10. Side members 12 and 14 should be of sufficient height to retain products within the unit, however it is not required that such members be of uniform height throughout their respective lengths. As shown most clearly in FIG. 2, the side members 12 and 14 of one embodiment include a portion 13 having a reduced height at the front portion thereof provided so that products may be more easily seen and removed from the unit. Each of the side members 12 and 14 may also include a bottom surface portion 15 which extends inwardly a predetermined distance from the lower edge portion thereof.

Figure 2:
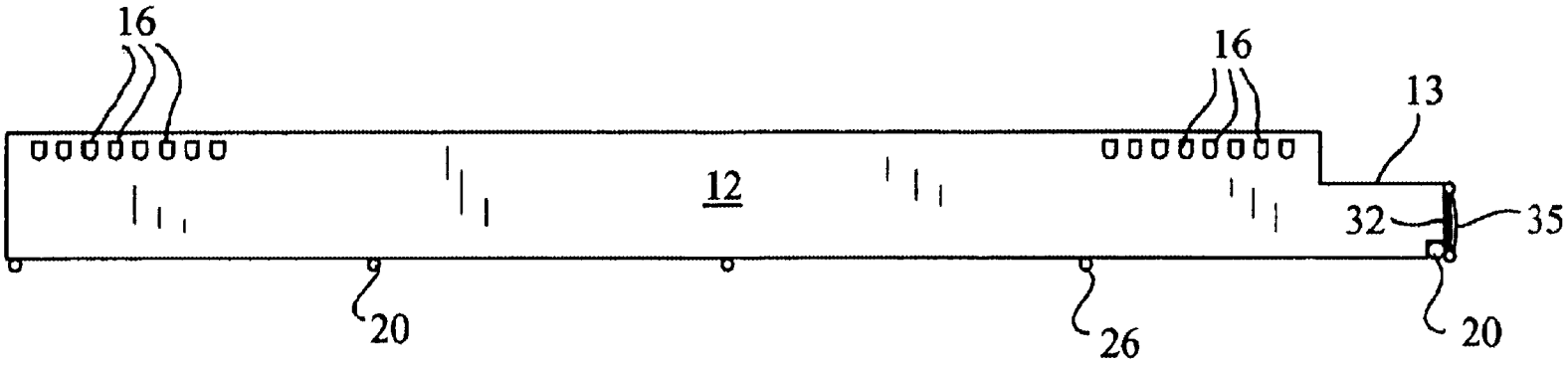
FIG. 2 is a side elevational view of the product storage and merchandising unit illustrated in FIG. 1.

A plurality of slots 16 are located in spaced apart relationship along the upper limit of side portions 12 and 14 at both the front and rear portions thereof. These slots are best seen in FIG. 2 and are used to receive and engage an attachment member for suspending the unit 10 below an existing shelf unit. Slots 16 need not be sized and shaped precisely as shown, but may be of any size and shape suitable for allowing an attachment member to be received therein. In the embodiment shown in FIGS. 1–5, a longitudinal hanging member 18 extends longitudinally across the upper limit of each side member 12 and 14, extending across the upper portion of each slot 16 thereby providing a structure for engaging an attachment member as will be hereinafter explained. It is also recognized that side members 12 and 14 may be formed with enclosed openings sized and shaped for receipt of an attachment member thereby eliminating the need for hanging members 18.

A series of transverse members 20 extend transversely at least substantially across the width of unit 10 between side members 12 and 14 forming at least a portion of a supporting surface for holding products positioned within the unit 10. The members 20 are spaced apart in a generally parallel arrangement along substantially the entire length of the unit 10 as best shown in FIG. 1. With the exception of the forwardmost transverse member, the members 20 are preferably fixedly attached to the underside of the two side members 12 and 14 to provide stability and support to the overall unit. The forwardmost transverse member 20 is elevated slightly with respect to the other transverse members 20 and extends through an opening or slot 21 formed in side member 12 and 14. This provides additional strength and stability to the front of the unit 10 particularly when the unit 10 is used in a gravity feed operation wherein the weight of all products positioned within the unit will bear against the front portion of the unit.

Figure 3:
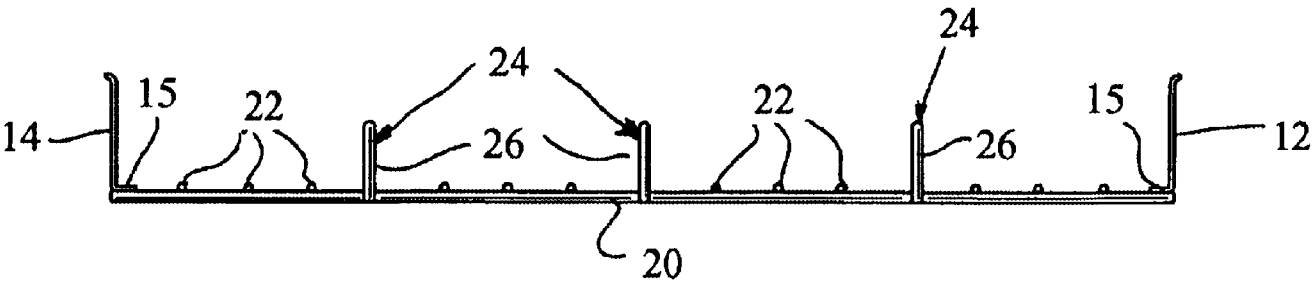
FIG. 3 is a rear elevational view of the product storage and merchandising unit illustrated in FIG. 1.

A plurality of channel members 24 are spaced in generally parallel arrangement along the width of the unit 10 and extend longitudinally substantially across the length thereof defining a plurality of product channels 25 as again best seen in FIGS. 1 and 3. Each channel member 24 preferably includes a rear vertical portion 26 extending upwardly from the rearwardmost transverse member 20, a substantially straight horizontal portion 28 extending away from vertical portion 26 along substantially the entire length of the unit 10, and a front vertical portion 30 extending downwardly from horizontal portion 28. The front vertical portion 30 is fixedly attached to the front transverse member 20 and the rear vertical portion 26 is fixedly attached to the rear transverse member 20. Any number of product channels 25 may be formed within unit 10 depending upon the shape and size of the products to be stored with each channel 25. Also, the width of each channel 25 within each unit 10 may likewise vary.

A series of longitudinal floor members 22 extend at least substantially long the length of the unit 10 perpendicular to the transverse members 20 as best shown in FIG. 1. Longitudinal floor members 22 are present in substantially parallel arrangement and form a track-like floor surface extending preferably from the rearwardmost transverse member 20 to the front transverse member 20 for supporting products positioned thereon. The floor members 22 are arranged such that at least two such members are positioned within each product channel 25 for supporting products positioned within a particular product channel 25. The longitudinal floor members 22 are preferably fixedly attached to the underside of the forwardmost transverse member 20 and to the upperside of the remaining transverse members 20. Any plurality of floor members 22 can be positioned and located in any spatial arrangement within each product channel 25 depending upon the size and shape of the products to be stored and merchandised within each channel 25. It is also recognized and anticipated that a solid floor member may also be utilized within each product channel 25.

A stop member 32 located at the front of the unit 10 extends at least substantially along the width thereof between side members 12 and 14. Stop member 32 is preferably constructed of a unitary sheet of material as shown in FIG. 1 and may include a pair of opposed channels 33 for receiving one or more information cards or graphic panels 35 (FIG. 2) for displaying pricing data, brand labeling or other information about the products stored within each product channel 25. Each product channel 25 may have its own card or graphic panel 35 associated respectively therewith if the products vary from one product channel 25 to another. The front stop member 32 may also take on other shapes and configurations such as being a single rod member or a plurality of rod members extending between side members 12 and 14.

Figure 4:
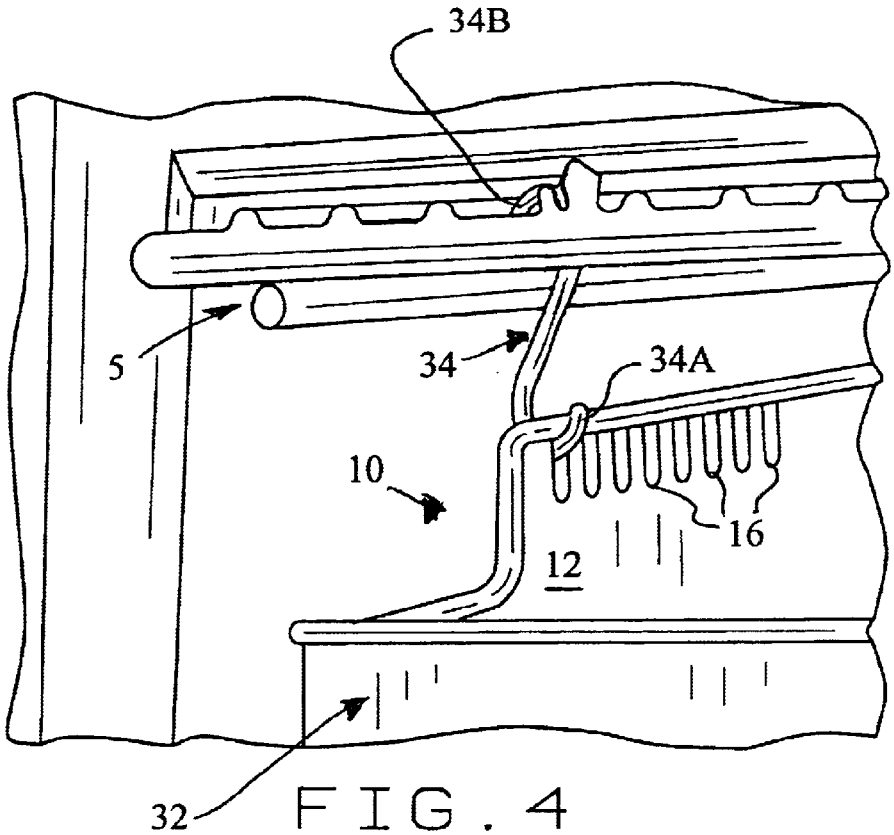
FIG. 4 is a fragmentary perspective view illustrating the use of a hook member for suspending the product storage and merchandising unit of FIG. 1 in operative position beneath a conventional shelving unit.
Figure 5:
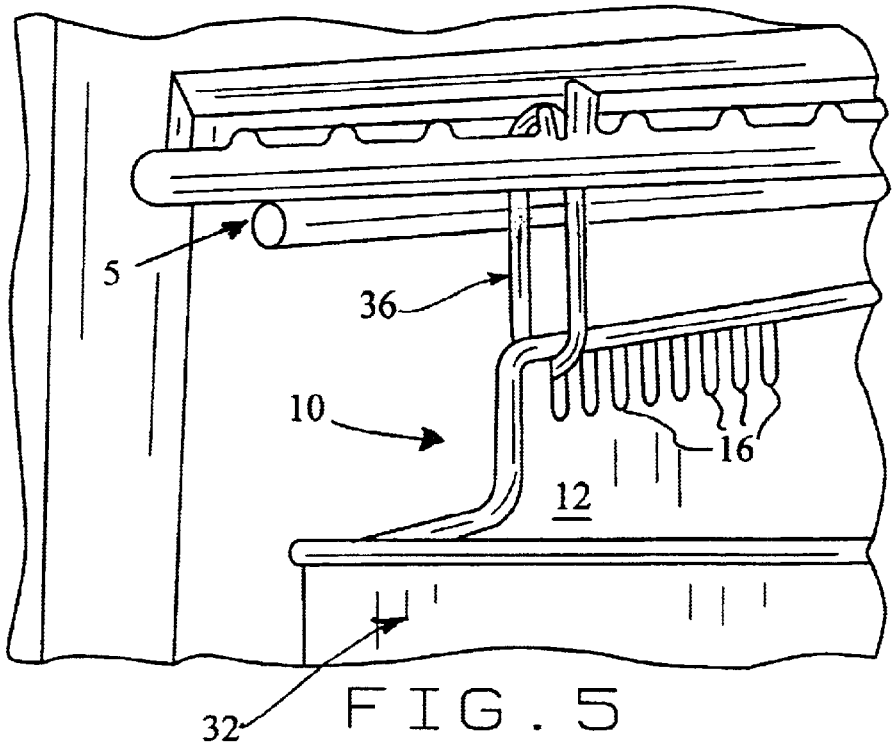
FIG. 5 is a fragmentary perspective view illustrating the use of a tie member for suspending the product storage and merchandising unit of FIG. 1 in operative position beneath a conventional shelving unit.

The present device 10 is suspended beneath an existing product shelving unit S by means of attachment members 34 or 36 as shown in FIGS. 4 and 5. Attachment member 34 (FIG. 4) is a hook-like member having one end portion 34A inserted through one of the slots or closed openings 16 and the other end portion 34B attached to an existing shelf unit S located thereabove. Attachment member 34 is preferably constructed of metal, but may be fabricated from a sturdy plastic or other suitable material. Attachment member 36 is a conventional tie type strip fastener which can be looped through one of the slots or closed openings 16 and then around a portion of the underside portion of an existing shelf unit S as best shown in FIG. 5. Attachment member 36 is preferably constructed of sturdy plastic or any other suitable material and may include an adjustment mechanism for feeding one end of the tie fastener 36 therethrough to adjust the overall size of the loop formed by the member 36. The loop adjustment mechanism may take on any of the wide variety of different known means for accomplishing this task. Four attachment members are generally used to secure the unit 10 to the underside of an existing shelf unit, one at each of the four respective corners of the unit, although any number of attachment members may be used depending upon the overall size of the unit 10. These attachment members are preferably all of the same kind, for example, all like attachment members 34 or all like attachment member 36, however it is contemplated that the attachment members may be used interchangeably, and that a different type member may be used at each attachment location. Other known attachment devices may also be utilized.

Attachment member 36 is particularly useful in that it allows for customizing the distance between the unit 10 and the existing shelf unit S located thereabove since tightening or loosing the tie strip loop will raise or lower the unit 10 accordingly. In this regard, regardless of the type of attachment member used, it is recognized that the attachment members may be of varying dimensions depending upon the spatial requirements of the unit 10 and the existing shelf equipment to which it will be attached. Appropriate adjustment of the distance between the front and rear portions of the unit 10 and the existing shelf unit located thereabove will also produce a gravity feed orientation.

The precise construction of the product storage and merchandising unit 10 may be varied without departing from the intended scope of the present invention. For example, in the embodiment illustrated in FIGS. 1–5, each side member 12 and 14 includes eight slots or closed openings 16 at both the front and rear portions of each side member. It is recognized and anticipated that any number of such slots or openings 16 may be associated with each side member 12 and 14 and that the slots or openings 16 may extend along substantially the entire length of each side member, or that any group or plurality of slots or openings 16 may be selectively spaced substantially along the length of each side including along the middle portion of each side member. Still further, the slots or openings 16 may be formed by spaced rod member forming the side members 12 and 14. Other variations are also possible.

Figure 6:
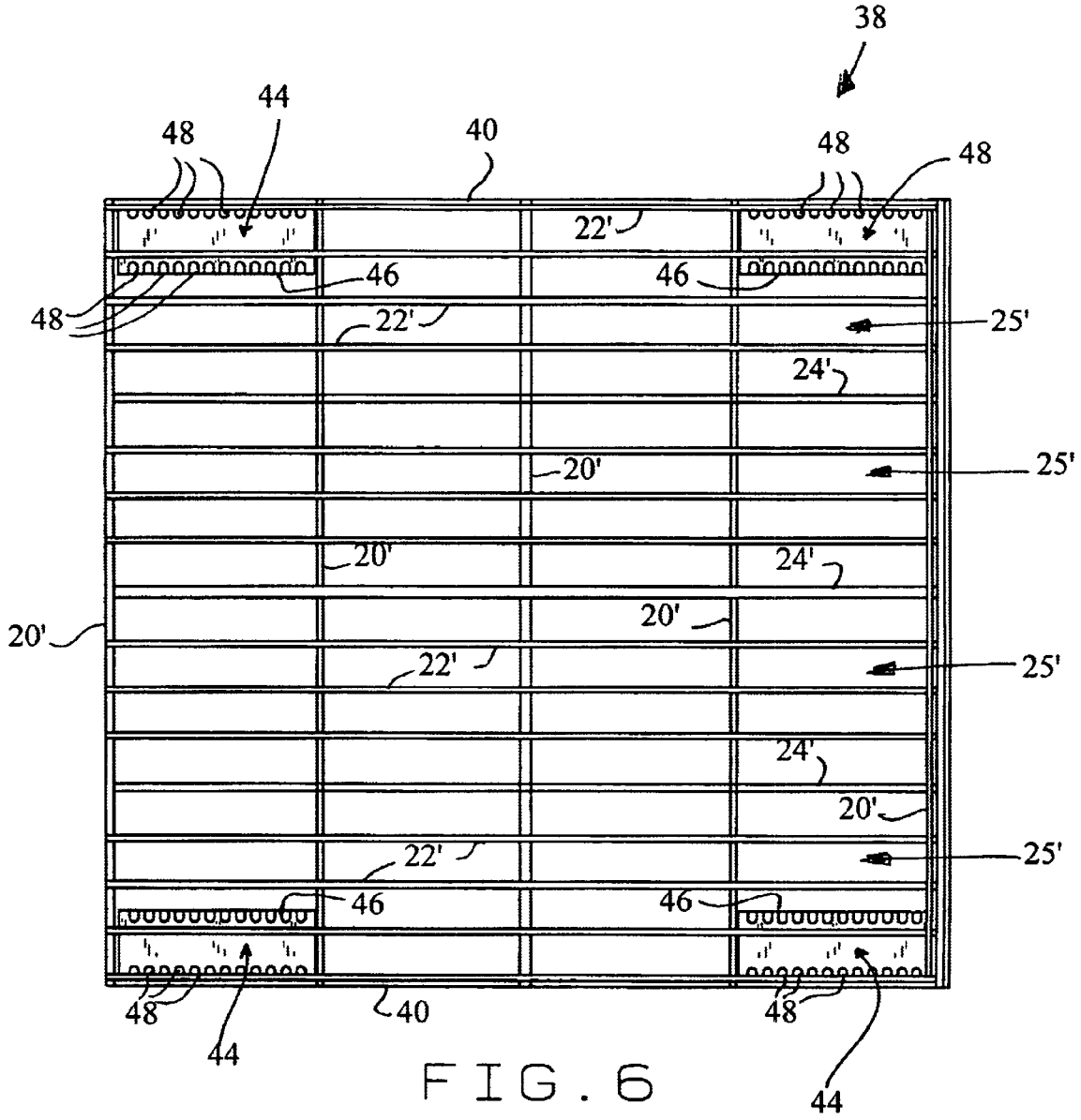
FIG. 6 is a top planform view of another embodiment of a product storage and merchandising unit constructed in accordance with the teachings of the present invention.
Figure 7:
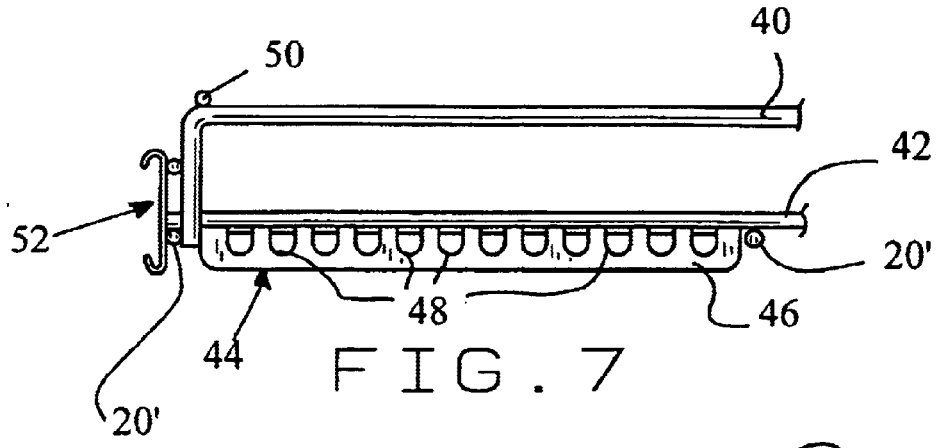
FIG. 7 is a partial side elevational view of the front portion of the product storage and merchandising unit of FIG. 6 showing the placement and orientation of a bracket member associated with the underside portion of the unit.

FIGS. 6 and 7 illustrate an alternative embodiment 38 of the present product storage and merchandising unit constructed in accordance with the teachings of the present invention. The embodiment 38 is substantially similar to the embodiment 10, but differs therefrom primarily with respect to the positioning of the openings through which attachment members 34 or 36 are inserted. In the unit 38 illustrated in FIGS. 6 and 7, the structure of side members 12 and 14 as disclosed with respect to embodiment 10 is not necessary and although such construction without the use of slots 16 may be used, such structure may be replaced with longitudinal rod members 40 and 42 (FIG. 7) or any other suitable structure sufficient to retain products within the unit 38. Instead of cutting the slots or openings 16 into the side members as illustrated in embodiment 10, bracket members 44 are fixedly attached to the underside of the unit 38, preferably, at each of the four corners thereof as best illustrated in FIG. 6. The brackets 44 are oriented longitudinally along the length of the unit 38 and each bracket 44 includes a spaced pair of openings 48 extending along at least a portion of the length of the respective bracket member. Each bracket member 44 is substantially U-shaped in configuration and each includes a pair of spaced downwardly extending side portions 46, each side portion 46 including a plurality of openings 48. The spaced openings 48 associated with the spaced side portions 46 are oriented in substantial alignment or registration with each other and are adapted to receive appropriate attachment members as will be hereinafter described. Although bracket members 44 have been described for housing the openings 48, it is recognized and anticipated that other means for positioning the openings 48 at the bottom or lower portion of the unit 38 may likewise be used such as forming the openings 48 in the lower portion of a side member such as side members 12 and 14 or such as forming loops or eyelets along the bottom portion of the respective side members and/or along the underside portion of the unit. Still other arrangements are likewise envisioned.

The unit 38, similar to unit 10, also includes a plurality of transverse members 20' extending between the side rod members 42; a plurality of channel members 24' extending from front to rear of the unit 38 defining a plurality of product channels 25'; a plurality of longitudinal floor members 22' forming a track-like floor surface within each product channel 25'; and a stop member 50 located at the front of the unit 38 for retaining products within each product channel 25'. The unit 38 also includes a front channel member 52 adapted to receive any number of information cards or graphic panels similar to the panels 35 for displaying pricing information, brand labeling or other data about the products stored within each product channel 25'.

The unit 38 is likewise suspended beneath an existing product shelf by use of attachment members 54 and 60. Attachment member 54 includes an upright hook portion 56 which is engageable with the underside portion of the existing shelf located thereabove and two substantially parallel rod portions 58. Rod portions 58 are inserted through a pair of openings 48 associated with each side portion 46 of each bracket member 44. The two rod portions 58, when engaged with a particular bracket member 44, provide greater stability because they are spaced apart thereby allowing the weight of unit 38 to be divided between the two rod portions. Also, since the rod portions 58 extend through two sets of spaced pairs of openings 48, still greater stability is provided and any rocking or swinging motion is likewise greatly reduced. Attachment member 60 includes an upright hook portion 62 and a single rod portion 64. Attachment member 60 lacks some of the stability of attachment member 54, but still provides adequate stability depending upon the particular application.

Figure 8:
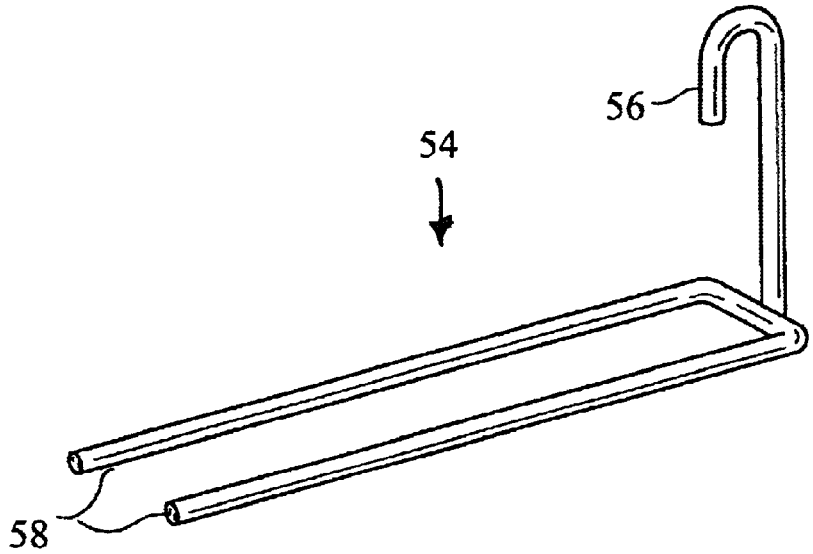
FIG. 8 is a perspective view of one embodiment of an attachment member for use in suspending the product storage and merchandising unit of FIG. 6 beneath a conventional shelving unit.
Figure 9:
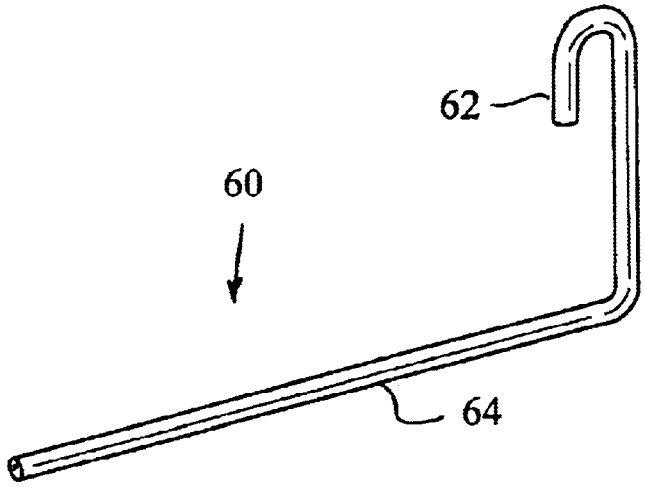
FIG. 9 is a perspective view of another embodiment of an attachment member for use in suspending the product storage and merchandising unit of FIG. 6 beneath a conventional shelving unit.

The upright hook portions 56 and 62 of attachment members 54 and 60 are shown in FIGS. 8 and 9 as facing toward the interior of the device. In this configuration, the attachment members are meant to engage a preexisting shelf unit. Upright hook portions 56 and 62 could, however, be fabricated so as to face away from the interior of the unit 38. In such a configuration, attachment members 54 and 60 could engage the openings associated with many of the upright support structures commonly used to support the existing product shelf such as the upright tubular support posts associated with many refrigerated display cases and cold vaults. In this regard, the hook portions 56 and 62 could also be fabricated to face towards the front or rear of the unit in a plane parallel to the side portions thereof likewise attaching to known upright tubular support posts having openings associated with all four sides thereof.

Although attachment members 54 and 60 are generally preferred for use with unit 38, attachment members 34 and 36 could likewise be used. If attachment member 34 is used to secure unit 38 to existing shelving, one end 34A of attachment member 34 would be inserted through one of the plurality of openings 48 and the other end 34B of attachment member 34 would be engaged with the preexisting shelf or with the upright support structure used to secure the existing shelving. If attachment member 36 is used to secure unit 38 to existing shelving, attachment member 36 would be looped through one of the plurality of openings 48 and then around the existing shelving as previously explained. Other attachment members may also be used.

It is also recognized that the openings 48 associated with unit 38 could likewise be positioned adjacent the top or upper portion of the unit 38 such as, for example, attaching the bracket members 44 to transverse members or to other appropriate structure associated with the upper portion of the unit 38. These transverse members or other appropriate structure could extend between the opposed side members or side walls of the unit 38 so long as such additional structure does not interfere with the loading and movement of the products within each product channel 25'. Other means for positioning the openings 48 and/or the brackets 44 at the top or upper portion of the unit 38 are also anticipated and contemplated such as by forming loops or eyelets along the upper portion of each of the respective side members and/or along the upper portion of the unit 38. In this regard, it is also recognized that the four bracket members 44 illustrated in FIG. 6 could be replaced with simply a pair of bracket members, one bracket member extending along substantially the length of the unit 38 on each opposite side thereof adjacent either the top or bottom portion of each of the opposed side portions thereof. Still further, it is also recognized and anticipated that each bracket member such as the bracket members 44 may include any plurality of sets or groups of openings 48 spaced in parallel relationship to each other such that the openings associated with each set of openings lie in alignment or registration with each other. As a result, instead of the spaced pair of openings 48 associated with brackets 44 illustrated in FIGS. 6 and 7, such bracket members may include three or more spaced sets of openings 48 adapted to receive appropriate attachment members such as the attachment members 54 and 60 illustrated in FIGS. 8 and 9. Use of more than two sets of spaced openings 48 will provide even greater stability to the overall unit when it is suspended beneath the existing product shelf located thereabove.

As is evident from the foregoing description, certain aspects of the present invention are not limited to the specific examples recited above, or to the specific embodiments shown in the drawings. Many of the features of the present invention may be modified in ways consistent with the teachings herein and without departing from the spirit and scope of the invention. It is therefore contemplated that still other modifications and applications, including equivalents thereof, will be obvious to one of ordinary skill in the art. For example, the side members 12 and 14 of the present unit 10 need not be constructed of a unitary sheet of material. Instead, these members could be formed of a grid structure having means for attaching the upper edge of each side member to the underside of existing product shelving. These side members may be constructed of metal or of a plastic material, or any other material suitable for the purposes and applications described herein. The side members may also be constructed with fully circumscribed openings therein such that the side members may be manufactured from a single piece of plastic or other suitable material without the need to attach a longitudinal hanging member such as the member 18 to each side member in order to hang the device.

Still further, the floor surface or track surface of the various product channels need not be constructed of longitudinal members, but may be made of a solid sheet of material providing a solid surface upon which products may rest. Similarly, the channel members may be formed of a solid, unitary sheet of material or such members may be formed of a grid structure. In instances where the floor of the various embodiments of the present unit is formed of a unitary sheet of material, it may not be necessary to provide the transverse members 20 and/or 20', although such members could be provided to give added support to the structure if desired. It is also contemplated that the entire unit 10 or 38 could be constructed from a single, unitary piece of molded plastic or other suitable material. Similarly, the stop member used in association with the unit 10 need not be comprised of channel member 32 but may, instead, be constructed from an additional transverse member extending at sufficient height across the width of the unit so as to retain products therein such as the member 50 in embodiment 38.

Still further, the specific attachment members used to attach the present units to the underside portion of existing product shelves need not be comprised of the hooks or ties described herein. It is contemplated that any of a number of known attachment devices could be used without departing from the spirit and scope of the present invention. In addition, it is not required that the present devices attach to the underside portion of an existing product shelf. Instead, the present devices may be attached directly to the upright support structures commonly used to hold the existing product shelving in place. Any means of securing the present devices in the unused space between existing product shelves is contemplated as part of the present invention. Furthermore, it is not required that the attachment members be attached to the upper or lower limits of the side members or to the underside of the unit as described herein. Instead, the attachment members may attach to various operable locations along the length of the respective side members such as between the upper and lower limits of each side member, so long as such attachment members do not interfere with or otherwise hinder the movement of products within the adjacent product channels.

Thus, there has been shown and described several embodiments of a product storage and merchandising unit constructed in accordance with the teachings of the present invention. Many changes, modifications, variations, and other uses and applications of the present constructions will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A product storage and merchandising unit adaptable for use with an existing product shelf comprising:

a floor portion;

first and second side members fixedly attached to said floor portion and having front and rear portions defining at least a portion of the length of said unit, each of said first and second side members including at least one opening associated with each of the front and rear portions thereof;

at least one stop member extending between said first and second side members adjacent the front portion thereof;

a plurality of channel members positioned in spaced apart relationship across the width of the unit defining at least two product channels; and a plurality of attachment members engageable directly with said at least one opening associated with each of the front and rear portions of said first and second side members and with the existing product shelf for attaching the unit to the underside portion of the existing product shelf.

2. The product storage and merchandising unit of claim 1 wherein said floor portion includes a plurality of transverse members and a plurality of longitudinal members.

3. The product storage and merchandising unit of claim 2 wherein said plurality of longitudinal members form a floor surface within said product channels.

4. The product storage and merchandising unit of claim 1 wherein said attachment members are hook members.

5. The product storage and merchandising unit of claim 1 wherein said attachment members are tie fasteners.

6. The product storage and merchandising unit of claim 1 wherein said at least one stop member is adapted to display pricing data or other merchandising information.

7. The product storage and merchandising unit of claim 1 wherein each of said first and second side members includes a plurality of openings associated with each of the front and rear portions thereof.

8. The product storage and merchandising unit of claim 1 wherein said at least one opening associated with each of the front and rear portions of each of said first and second side members is positioned and located adjacent the upper portion of said first and second side members.

9. The product storage and merchandising unit of claim 1 wherein the at least one opening associated with each of the front and rear portions of each of said first and second side members is positioned and located adjacent the lower portion of said first and second members.

10. A product storage and merchandising unit adaptable for attachment to the underside portion of an existing product shelf comprising:

a floor portion;

first and second side members attached to said floor portion, each of said first and second side members including a plurality of openings extending along at least a portion of the upper portion thereof;

at least one stop member extending between said first and second side members for holding and retaining products positioned within said unit;

a plurality of channel members positioned in spaced apart relationship across the width of said unit defining a plurality of product channels for positioning products therewithin; and a plurality of attachment members extending through at least some of the plurality of openings associated with each of said first and second side members and attachable to the underside portion of an existing product shelf for attaching said unit to the existing product shelf.

11. The product storage and merchandising unit of claim 10 wherein said plurality of openings associated with each of said first and second side members includes at least two groups of openings, each group including a plurality of openings, one group of openings being located adjacent the front portion of each of said first and second side members and one group of openings being located adjacent the rear portion of each of said first and second side members.

12. A product storage and merchandising unit adaptable for use with an existing product shelf comprising:

first and second side members having front and rear portions, each of said first and second side members having a plurality of openings located along at least a portion of the upper portion thereof;

a plurality of transverse members extending at least substantially across the width of said unit between said first and second side members;

at least one stop member extending between the front portions of said first and second side members;

a plurality of channel members extending longitudinally at least substantially along the length of said unit from a position adjacent the at least one stop member to a position adjacent the rearwardmost transverse member, said channel members defining a plurality of product channels for holding products positioned therein;

a plurality of longitudinal members extending at least substantially along the length of said unit from at least the rearwardmost transverse member to at least the forwardmost transverse member, said longitudinal members being fixedly attached to said transverse members and forming a product holding surface within each of said product channels; and a plurality of attachment members engageable directly with at least some of said openings and with the existing product shelf for attaching the unit directly to the underside portion of the existing product shelf.

13. The product storage and merchandising unit of claim 12 wherein said stop member includes a pair of channels adaptable for receiving at least one graphic panel for displaying and communicating information to a consumer.

14. A product storage and merchandising unit adaptable for use with an existing product shelf comprising:

front, rear and opposed side portions and a floor portion extending therebetween, said opposed side portions having top and bottom portions associated respectively therewith;

a plurality of channel members positioned between said opposed side portions and extending between said front and rear portions defining at least two product channels for receiving products therewithin;

at least two sets of openings positioned and located adjacent at least a portion of either the top or bottom portion of each of said opposed side portions, said at least two sets of openings associated with one of said opposed side portions being positioned in spaced apart parallel relationship to said at least two sets of openings associated with the other of said opposed side portions such that the openings associated with one of said sets of openings lie in registration with the openings associated with another of said sets of openings, each of said sets of openings including a plurality of openings; and a plurality of attachment members each of which is directly engageable with at least one opening associated with each of said at least two sets of openings associated with said opposed side portions and engageable with the existing product shelf for attaching said unit directly to the underside portion of the existing product shelf.

15. The product storage and merchandising unit of claim 14 wherein each of said attachment members includes a hook portion and two substantially parallel rod portions, each of said rod portions being insertable through a pair of openings associated with said at least two sets of openings positioned adjacent said opposed side portions.

16. The product storage and merchandising unit of claim 14 wherein each of said attachment members includes a hook portion and a rod portion, said rod portion being insertable through a pair of openings associated with said at least two sets of openings positioned adjacent said opposed side portions.

17. The product storage and merchandising unit of claim 14 wherein said at least two sets of openings positioned adjacent the bottom portion of each of said opposed side portions.

18. The product storage and merchandising unit of claim 17 wherein said at least two sets of openings are positioned adjacent the underside portion of said floor portion.

19. The product storage and merchandising unit of claim 14 wherein said at least two sets of openings are positioned and located adjacent the top portion of each of said opposed side portions.

20. The product storage and merchandising unit of claim 14 including at least a pair of brackets, each of said brackets including said at least two sets of opening, said brackets being positioned and located adjacent the underside portion of said floor portion.

21. The product storage and merchandising unit of claim 14 including four brackets, each of said brackets including said at least two sets of openings, one of said brackets being attached to the underside portion of said floor portion adjacent each of the four respective corners of said unit.

22. The product storage and merchandising unit of claim 14 wherein the front portion of said unit includes a stop member for holding and retaining products within each product channel.

* * * * *

UNITED STATES PATENT AND TRADEMARK OFFICE

CERTIFICATE OF CORRECTION

PATENT NO. : 6,688,478 B2
DATED : February 10, 2004
INVENTOR(S) : Donald J. Miller, Jr. et al.

It is certified that error appears in the above-identified patent and that said Letters Patent is hereby corrected as shown below:

Column 12,
Line 20, after the word "*openings*", insert -- are --;
Line 33, delete "opening" and replace with -- openings --.

Signed and Sealed this

Twenty-second Day of June, 2004

JON W. DUDAS
*Acting Director of the United States Patent and Trademark Office*